US007649134B2

(12) United States Patent
Kashioka

(10) Patent No.: US 7,649,134 B2
(45) Date of Patent: Jan. 19, 2010

(54) METHOD FOR DISPLAYING MUSIC SCORE BY USING COMPUTER

(75) Inventor: Seiji Kashioka, 19743 Vista Hermosa Dr., Walnut, CA (US) 91789

(73) Assignee: Seiji Kashioka, Walnut, CA (US)

( * ) Notice: Subject to any disclaimer, the term of this patent is extended or adjusted under 35 U.S.C. 154(b) by 85 days.

(21) Appl. No.: 10/583,047

(22) PCT Filed: Dec. 16, 2004

(86) PCT No.: PCT/IB2004/004149

§ 371 (c)(1),
(2), (4) Date: Jun. 15, 2006

(87) PCT Pub. No.: WO2005/062289

PCT Pub. Date: Jul. 7, 2005

(65) Prior Publication Data

US 2007/0144334 A1 Jun. 28, 2007

(30) Foreign Application Priority Data

Dec. 18, 2003 (JP) ..... 2003-420412

(51) Int. Cl.
*G10H 1/00* (2006.01)

(52) U.S. Cl. ..... 84/600; 84/601; 84/486

(58) Field of Classification Search ..... 84/600–604, 84/486

See application file for complete search history.

(56) References Cited

U.S. PATENT DOCUMENTS 5,690,496 A * 11/1997 Kennedy ..... 434/307 R
5,913,259 A * 6/1999 Grubb et al. ..... 84/610
5,952,597 A * 9/1999 Weinstock et al. ..... 84/609
6,107,559 A * 8/2000 Weinstock et al. ..... 84/634
6,166,314 A * 12/2000 Weinstock et al. ..... 84/483.1
6,333,455 B1 * 12/2001 Yanase et al. ..... 84/609
6,365,819 B2 * 4/2002 Yamada ..... 84/609
6,376,758 B1 * 4/2002 Yamada et al. ..... 84/612
7,098,392 B2 * 8/2006 Sitrick et al. ..... 84/477 R
7,189,912 B2 * 3/2007 Jung ..... 84/610
7,579,541 B2 * 8/2009 Guldi ..... 84/470 R
2004/0069115 A1 * 4/2004 Hiratsuka et al. ..... 84/483.1
2008/0156171 A1 * 7/2008 Guldi ..... 84/466

* cited by examiner

*Primary Examiner*—David S. Warren

(57) ABSTRACT

In displaying a music score by using a computer, there is provided a function for matching an in-music position being updated in a computer with an in-music position being played. According to the in-music position, display update is controlled. Space of music score display is divided into several partitions. The timing of updating each partition is defined as the moment when the in-music position in the computer has arrived at the position in the page obtained by predetermined function from the position of the page divided and the partitions are successively updated. Thus, it is possible to realize smooth display update capable of displaying the preceding partition and holding the display with a sufficient width before and after the position being played. Here, a plurality of timing input means are provided for matching the in-music position required here, so that a trace shift in the lower level can be corrected by means having a higher-level reliability when necessary. When playing in concert, the music score is different for each part but the display update can be controlled by supplying the in-music position information.

15 Claims, 6 Drawing Sheets

METHOD FOR DISPLAYING MUSIC SCORE BY USING COMPUTER

CROSS REFERENCE TO RELATED APPLICATIONS

This application is based on International Application No. PCT/IB2004/004149, filed Dec. 16, 2004, and Application for Japanese Patent No. 2003-420412, filed Dec. 18, 2003.

BACKGROUND OF THE INVENTION

This invention is related to control method of various type of music score on electronic display devices.

For long time paper music score have been used to play music. With long composition, it became necessary to turn pages during performance. It has been trouble to players who use both hands, for example piano players. Recent growth of computer and flat panel display enables to display music score on electronic display devices. Using computer opens possibilities of computer aided display, and has inspired inventions.

Renewal or overwrite is necessary when perform on music score comprising plural pages. It is technical challenge to acquire timing of turning page in case played by human not by machine. For example, with method shown in Japanese patent application publication number JP 2003-177745 A, system input button signal, which user operate a little before play position reaches the end of page, and renewal predetermined portion of music score image, then renewal remaining part after chosen time period. This is for keeping playing point is shown on display without interrupt. With another method shown in Japanese patent application publication number JP 2003-223166 A, system also uses two-step renewal. Here, the first step is initiated not by switch input, but by detecting the timing of playing point comes to predetermined point. Playing point is identified by compare the audio input with music notes information. The second timing is determined with calculation of time for playing remaining portion from music notes information. Thus, page turns are done without manual operation.

These methods had following three problems. First, the second timing for renewal remaining portion is determined at the first timing. So, in case of playing slow, take pause, or repeat for practice after the first timing, the remaining portion may be overwritten to new contents even playing point has not reached the end of page. Second problem is the first timing is chosen near the end of the page to avoid the problem described above, Next page is shown right before the end of page. But, to see next page early enough is important for better performance, for adjusting current playing and preparation. Third problem is that these methods ask user some setting procedure. For example method in the second reference requires to point and record the place of first timing for every page. For the method in second reference, setting of time difference between first and second image renewal. This may vary according to each music and percentage completion.

There were inventions aimed at use for ensemble. Japanese patent application publication number JP 2002-169541 A disclosed system which input full score information and distributes part music score information to each electronic display terminal through network. Each display terminal has input device for specifying timing on turning page. All terminals in the same part turn page in conjunction with input from any one of input devices in the part. But each part needs its own input operation because page turning point are generally different.

Many techniques were disclosed about driving sequencers or MIDI instruments following conducting baton. For example, Japanese patent application publication number JP H09-090941 A (cited as reference 4 later) disclosed technique, with which tempo and dynamic was controlled by detection of beat timing and amplitude of baton using angular velocity sensor built in the baton.

BRIEF SUMMARY OF THE INVENTION

The first objective of this invention is to realize renewal of music score display, which gives user more peace of mind. In concrete terms, there is no renewal or overwrite at the playing point and heading portion of next page is displayed enough before playing point reaches end of page.

The second objective of this invention is to make it reliable to follow the playing point. Matching sound input with music notes information has problem of noise interfusion and players miss. Further extracting each instrument tone from mixed sound of ensemble is still under research. This invention intends method, which can be realized with current technology and also is expandable with future technology.

The third objective of this invention is to realize function of customize by learning. Composer's description is not sufficient to decide detail of tempo, agogic flicker of tempo, length of fermata, etc. Players or conductor actually set these details. These are not solid in repeating performance, but there are certain center values for each details for each player. So, this invention intends to system, which learns each details from performance and then provides smooth and automatic follow up of performance and renewal of display.

The forth objective of this invention is to provide system which displays for all players of ensemble such as orchestra, who play on different music, in the manner asks minimum operation for renewal.

The fifth objective of this invention is to provide various novel support functions, which was not possible with paper music sheets.

In accordance to this invention, to accomplish the first objective, display space is divided into many portions cyclically renewed, and renewal of a portion takes place when playing point is at certain different point determined from position of said portion. Pattern of division is decided from type of music score. Divided portions are numbered from left upper most one. But, the last one continued to the first one in renewal sequence. Thus sequence forms a ring. Timing of renewal certain portion is acquired as portion number from mapping table and renewal takes place during playing point is in portion of acquired number. Plural mapping tables are prepared corresponding to user's taste. In most simple mapping table, number is selected as opposite one in the ring. Renewal was done at once for whole image with conventional method. But, with this invention, renewal takes place gradually portion by portion. This enables that enough portions stay displayed before and after playing point.

Several dividing styles are shown here with figures. FIG. 1 shows music score of one staff per system for general single voice instrument. It shows an example of division in case using display device 101 in horizontally long setting. Music score is displayed in a window 10. It is convenient for control to assign one divided portion to one staff. Numbers are assigned from top to down on six portions from 11-1 to 11-6 in the figure.

Separating band 12 illustrated between second and third portions in the figure shows that recent renewal took place in 11-2 portion. This separating band may be displayed animated design of rolled paper going down. A few said mapping tables for FIG. 1 are shown in the following;

TABLE 1

| Portion No. | 1 | 2 | 3 | 4 | 5 | 6 |
|---|---|---|---|---|---|---|
| Mapping 1 | 4 | 5 | 6 | 1 | 2 | 3 |
| Mapping 2 | 5 | 6 | 6 | 1 | 1 | 2 |
| Mapping 3 | 6 | 6 | 6 | 1 | 1 | 1 |

Renewal for portion of number in the first row takes place when playing point is in portion of number in row of mappings. Mapping 3 corresponding to method of renewing portion at opposite side against playing portion in the ring. With mapping 2, there is no renewal nor separating band while playing point is in portion number 3 and 4, and whole page is displayed a little while. With mapping 3, Upper half portions are renewed while playing point is in the bottom portion 6, and lower half portions are renewed when playing point go in to the top portion 1. Neither renewal nor separating band is there during further long time while playing point is in mid portions.

When two staves are used for such as piano, one portion includes two staves and total number of portion is reduced to half. Also, three staves are used for music score of solo voice or instrument plus piano, and number of division is one third. Setting display in portrait or landscape, and number of division should be determined according to player's age, eyesight and complexity of music score. They can be customized by setting dialogue. All these are realized with stripe style division and control. If number of division runs short, dividing further in horizontal direction as shown in the following paragraph gives sleek renewal.

It is relevant to bring different division for score including many voices for such as chorus or ensemble. FIG. 2 shows an example of division for such cases. In this example, window 20 is divided in 3 rows and 4 columns, 12 portions 21-1 to 21-12. Each row includes staves for violin, cello and piano. Identifier of voices or its abbreviation 22, brackets, clefs 23 and signatures are placed at left side and included in the leftmost portion. Separating bands between portion 21-5 and portion 21-6 shows latest renewal took place in portion 21-5.

Mapping tables as shown in following Table 2 are used for control of renewal.

TABLE 2

| Portion No. | 1 | 2 | 3 | 4 | 5 | 6 | 7 | 8 | 9 | 10 | 11 | 12 |
|---|---|---|---|---|---|---|---|---|---|---|---|---|
| Mapping 4 | 7 | 8 | 9 | 10 | 11 | 12 | 1 | 2 | 3 | 4 | 5 | 6 |
| Mapping 5 | 10 | 11 | 11 | 12 | 12 | 12 | 1 | 1 | 1 | 2 | 2 | 3 |
| Mapping 6 | 7 | 7 | 7 | 7 | 11 | 11 | 11 | 11 | 3 | 3 | 3 | 3 |

Renewal for portion of number in the first row takes place when playing point is in portion of number in row of mappings. Mapping 4 corresponding to method of renewing portion at opposite side against playing portion in the ring. With mapping 5, accelerating renewal at row 1 to middle of row 2 takes place while playing point is in the last row, and slowing renewal followed when playing point moved into first row. There is no renewal while playing point is in portions 4 to portion 9. With mapping 6, reaches of playing point to right end portion invoke renewal of portions in previous row.

Full score of large orchestration or opera has more than 10 staves or even 30 staves sometimes. FIG. 3 shows an example of division for these full scores. Two display devices 101-*a* and 101-*b* are used side by side, corresponding to printed full score. If display device of enough size and resolution is available, one display can be used in horizontally long setting. In this example, there are 6 for each display, total 12 portions from left end 31-1 to right end 31-12. Each left end portion 31-1 and 31-7 includes instrument names, voice parts, and role names 32, brackets, clefs and signatures. Separating band 33 between portion 31-2 and portion 31-3 is shows last and latest renewal. This display is controlled also with mapping table. Table 3 shows three example of mapping.

TABLE 3

| Portion No. | 1 | 2 | 3 | 4 | 5 | 6 | 7 | 8 | 9 | 10 | 11 | 12 |
|---|---|---|---|---|---|---|---|---|---|---|---|---|
| Mapping 7 | 7 | 8 | 9 | 10 | 11 | 12 | 1 | 2 | 3 | 4 | 5 | 6 |
| Mapping 8 | 10 | 11 | 11 | 12 | 12 | 12 | 1 | 1 | 1 | 2 | 2 | 3 |
| Mapping 9 | 10 | 10 | 10 | 10 | 10 | 10 | 4 | 4 | 4 | 4 | 4 | 4 |

Mapping 7 corresponding to method of renewing portion at opposite side against playing portion in the ring. With mapping 8, accelerating renewal at row 1 to middle of row 2 takes place while playing point is approaching right most end, and slowing renewal followed when playing point moved into leftmost portion. There is no renewal in the left half display while playing point is in left half, and there is no renewal in the right half display while playing point is in right half, so that left end objects 32 in each side display can be referred always. These may be different page by page.

It is common that there are two or more systems in one page in printed full score, because less staves needed in a system when some parts have no notes to play in certain portion of music piece. It is easier to look and less page turn by this format. Same format is possible with this invention. FIG. 4 shows such combination of division. Right side is same as in FIG. 3, and left side is same as in FIG. 2 having 2 columns 3 rows and 6 portions. Mappings in table 3 are also available to control renewal for this format.

Some display built in instrument is small. Many electronic keyboard instruments have displays showing one or two systems of two staves each. Renewal can be controlled with division same as in FIG. 2 for two systems, and same as one side in FIG. 3 for one system. Showing separation band such as shown as 24 in FIG. 2, is helpful for player.

In foregoing description, number of division is integer and renewal takes place portion by portion. Example in FIG. 1 works with this. But, measures per system may vary and may be not equal to number of horizontal division in such cases shown in FIG. 2, FIG. 3 and FIG. 4. For more general division, a real number from 0 to 1 is defined as position corresponding to all systems in one page, which are deemed as concatenated. Mapping function is defined in which independent and induced variable are both in the range of 0 to 1 instead of mapping table. For example in FIG. 2, the first system is assigned to 0 to 1/3, and the second system is assigned to 3/1 to 2/3. Because lengths of measure are not even, position of measure to be renewed is calculated as mean value of position of both side barlines. Playing point can also be mapping on the same scale. So, renewal timing of a measure can be calculated by said type of mapping function.

FIG. 5 shows three samples of mapping function. In each graph of (A), (B), (C), horizontal axis corresponds to independent variable of position of measure to be renewed. Vertical axis corresponds to induced variable of playing point.

Graph (A) shows mapping function generalized from mapping 2 in table 1 or mapping 4 in table 2. For example portion 3 is located from 2/6 to 3/6, and position of center is 5/12. Value of the function corresponding 5/12 in horizontal axis 51 is 11/12 in vertical axis 52. Position of 11/12 is middle point of portion 6. When playing point comes to the point, portion 3 is renewed. Graph (B) in FIG. 5 shows mapping function generalized from mapping 2 in table 1 or mapping 5 in table 2. Renewal starts when playing point comes to 2/3 in the scale, and accelerated until renewal goes middle of page when playing point comes to value 1, that is end of page. Interval 53 indicated by two dotted lines has no induced value. This means that no renewal takes place while playing point is in the interval. Graph (C) in FIG. 5 shows mapping function generalized from mapping 3 in table 1. No renewal zone 54 is wider than graph (B).

To respond special playing sequence is crucial to real application. There may be repeat in music piece. Sometimes it requires going back plural pages, and it is not easy for player to handle this long repeat. Also, there may be trouble comes from jumps forward or backward such as dal segno, da capo, and coda. Also, it is common practice to cut off some portion of music piece for opera and ballet. With this invention, user specifies by dialogue about playing how many times for each repeat or cut off positions, etc. This is a kind of customize. No dialogue leads the sequence specified by composer. According to these specified sequence, music score is concatenated and displayed. So, there is no jump on the display. But, these notations are left to notify the player their existence.

First objective of the invention is accomplished with above-mentioned scheme. No adjustment is necessary for each music score or page. But, user can set general preference of mapping function according to taste or percentage of completion.

For further easy operation, specification of sequence can be skipped with following scheme. FIG. 6 shows this with same division of FIG. 2. When playing point approaches end of repeat 61, next portion 62 is displayed next at portion 11-5 and 11-6 in this example, also heading part of repeat 63 is displayed at preferably top portions of 11-1 and 11-2 in the same time. Separation band 12 should show up because music score in portion 11-2 and 11-3 are not necessarily continued. After these setting, playing point tracking function described later detects which of 62 or 63 the playing point enters. Then entered portion is expanded there after and selection of repeat is memorized.

In accordance to this invention, to accomplish the second objective, plural means for timing input are furnished and given priority levels to be chosen. Examples of timing input are clock signal as first level, playing sound as second level, detection of conductor's tact as third level, and direct in put of tact as forth level. First level is lowest priority level and forth is highest. It is not limited to these examples and levels. Input of higher level is dealt as reliable. MIDI input or audio sound input can be selected as playing sound of second level, as well as nothing for this level. There are many techniques proposed for detecting conductor's tact, such as image input and analysis, utilizing angular acceleration sensor built in baton, or other new techniques. Conductor's tact input is option. A mouse or foot pedals connected as mouse can be used as forth level input. Now, MIDI, abbreviation of "Musical Instrument Digital Interface", is defined as standard of various electronic music instruments.

Here described is method of expressing time in performing music piece. It is preferable to use same one with MIDI, because it is easier to connect this system with MIDI system. There minimum unit of time is length of quarter note divided by resolution number. Resolution number of 24 is adopted in MIDI 1.0. This corresponds to triplet of $64^{th}$ note. Also, numbers such as 96, 240, 384, and 480 are candidates of resolution number. 24 is used as resolution number in under description, but it goes without saying that other numbers can be used. Physical time length of one unit is replaced as one clock and used as unit for places and length of musical notes. Length of this clock has not absolutely fixed value, but varies according to tempo of actual performance and to agogic fluctuation.

In this system, timing of every clock are generated in physical time, so music inside system progresses. System has music time progressing in autonomous way, and input from outside are used for modification of timing. This point is different with conventional system. Duration time of one clock is set initially for example 41.6 ms as 24th of 1 s, which is duration of quarter note with tempo of 60 per minute, 20.8 ms for tempo of 120 per minute. Also, In case tempo marks are used, standard tempo of 132 for Allegro, and 72 for Andante are adopted. Digital music information may have adequate tempo indication. One measure, or bar in other word, include 96 clocks as 4 times of 24 in meter of 4 4th, 144 clocks as 12 times of half of 24 in meter of 12 8th. Position of each note is expressed with combination of measure number, beat number and clock, or in other word tick. This is called MBT scheme. In this description it is called as "music time". Further two music time are defined here; "performing music time" as position of music sounding by performance, and "internal music time" as music time maintained in the computer.

"Takt" in this description means takt of conductor's beat, or assumed takt in case of absence of conductor. In most case it is same as duration of base note or denominator in meter. But, two or three base notes become combined one takt in tempo of more than 140 per minute. In contrary base beat are subdivided in slow as tempo of less than 50. Conductors take their own different option about takt in these border tempo and music pieces. Digital music information may have default takt for each part of music, and conductor may set differently with this default. Now, beat in MBT scheme is equal to quarter note, so it may be different with this takt.

Timer, which is built in computer, generates time duration of clock above mentioned, and with this first level timing queue internal music time progresses clock by clock. If there is upper priority timing input, clock duration is modified to fit in performance. In places specified as zone of changing tempo such as ritardando, clock durations are calculated by interpretation program so that they are elongated by geometric progression. Alternative first level timing input is MIDI timing clock. MIDI code assigned for synchronization between electronic instruments is decoded in the MIDI interface.

Second level timing input comes from detection of sound of performance. In case MIDI signal from MIDI instrument is set as input, tone of key and timing of note-on, that is onset, come in from MIDI interface. In case detection of audio sound is set as input, picked up audio signal is digitized with an internal analog to digital converter, and periodically analyzed with fast Fourier transform program or fed to group of filters set for each tone. And then rising edge are detected by observing these output, as well as tone height.

Thus detected timing is converted to the nearer internal music time. If tone is matched and also timing is close with tone expected from music information, it is adopted. If different tones with music information are consecutively input, there may skip in playing position. Search is initiated. Detected group of tones and clock intervals between them are matched with those from music information. Matching position in music information starts from expected point and moves before and after the point in series, but not exceeds the range of display. Matching of intervals should have certain allowance. If successful matching found, pair of performance music time and physical time is adopted and memorized.

Third-level timing input is detection of conductor's takt, for which various scheme of building in the baton such as angular velocity sensor, acceleration sensor, distortion sensor or emitting diode combining with fix position receptor. These try to detect motion of baton. If baton gotten heavy is not accepted, schemes of taking video image of conducting with video camera and analyzing image to detect takt are utilized. Detail of these schemes are already disclosed, and omitted in this description. In this invention, scheme is not specified to one. Control after detection is described hereafter. It should be supposed as detection is not perfect and baton may stop intentionally. Further this third level input is option and system works without this input. When takt is input, it is processed as performing music time must be with the takt.

Forth-level timing input is direct input of takt using reliable equipment such as mouse or foot pedal. This input means is introduced because second and third level input is not 100% reliable. An operator, who understands music performance, is necessary for this input. One of player whose hand or foot is available can do this, or exclusive operator may do this at big orchestra or Opera Company. This may be done from remote place through network. Music score display of this invention includes a cursor showing position of internal music time in music score display. If this internal music time does not match with performing, operator detects that and correct music time by direct takt input. Detail of this operation follows. If difference is within half takt time, one left button click input can fix the displacement. If system is more than one takt behind, additional left button click works. If system is ahead more than one takt, pushing right button suppress first, second and third level input, so internal music time stops, then performance time comes to the point, release right button and one left button click at the takt fix the difference. This hold operation by right button is used at fermata or at portion of agogic fluttering tempo caused by performer's conditions. Left button is active even right button in on. Left button input is taken as takt timing.

Every time there is a first level clock input, priority procedure carry forward internal music time. If there is upper level timing input, take its music time as refreshed internal music time. After upper level input, lower level input of older music time is neglected. Calculate modified tempo for each level input and highest level tempo is adopted as tempo of following period. With this modification, first level clock will fit in the performing tempo. During right button is on, this modification of tempo is not applied, because that portion has peculiar tempo, or it is time of correcting internal music time.

In accordance to this invention, to accomplish the forth objective, renewal of different music score display for each part should be executed. Each part music score has different degree of condense, so renewal timings are different. As described above, performing music time is input in highly reliable way when following up performance, and maintain as internal music time. So, by distributing this internal music time to all display at various parts, and it is possible to calculate where in display is corresponding to the internal music time. One terminal is enough for following up performing time, and display renewal at all other terminal can be executed automatic way.

In accordance to this invention, to accomplish the third objective, tempo of performing is recorded and used it in the form of clock in next performance. For details, all takt or clock duration are recorded. We call this record as "time information". Takt duration is transformed into clock duration using the meter there in music information. Thus first level timing is generating with these clock durations. We call this way as "play back mode". It is "recording mode" in the first time performance. From second time or later play back mode, recording mode, and "simultaneous play back and record mode" are possible options. As recorded data is stored as file in memory system, user can select one data from plural past recordings. Partial overwrite is also possible and user can refine the recorded time information in every performances.

Fifth objective is to provide various useful tools. Many tools can be built on the basic scheme of this invention. At first, playing point can be displayed as cursor on the music score display, using internal music time. It is possible because music time and position in display are connected for each notes when they are drawn. Many design of displaying cursor are used already. For example, a gray or color vertical bar running along staff or system, a wedge running above the staff, a ball bounding with takt above the stem, are typical design.

Long rests appear at some parts in ensemble or choral works. It is common for percussion or trombone part in classical works. In conventional printed part music score, it is just written as for example 100 measures rest. Players must count precisely these rests unless they memorize music piece very well. With this invention, system provides count of rests for players. Present music time, that are measure number and beat number, can be displayed in some part of display, along with work name, movement, scene number. Further remaining measure and beat counts of rest can be displayed to help player. Even for short rest it is helpful.

Big problems have been in exactly informing all players about restart point in music piece, after interruption. Much of precious time has been spent for just telling the starting point. Rehearsal numbers are put on for this purpose, but conductors often want specify more detailed points. In this invention, conductor's music score display is combined with tablet device. Pointed starting point is transformed music time, and is delivered to all display control, and then transformed into point on each display, cursors are moved to the point. If necessary jump to different page is possible. Also, to make comment on phrase on some part can be done by pointing on full score at conductor's display: It will be transmitted to cursor display of specified part. On the reverse, question from player to conductor can be assisted by player's pointing at touch panel, which is transformed to position in conductor's display. Even for personal practice with system with only one display, pointing to specify restarting point or repeating range is supported by this system.

Now, the merits of this invention are listed. At first, with this invention, users feel piece of mind compared with paper print music score as well as conventional electronic music score display. Because heading part is displayed enough ahead, and playing point near bottom is never overwritten and bottom part is kept a little while after playing point goes up to next page. It is nicely fit to both early stage rehearsal and performance. Thus turning page is carried smoothly in optimal way. It is possible to display full page image enough long for effect of association by imaging which is possible imprinted music score. It cause a sense of reassurance when play again.

Secondly, generally applicable display renewal control scheme in this invention does not require setting operation for each music score or page. With printed music score it was sometimes necessary to turn back in a hurry when it comes to repeat, da capo or dal segno. Prior inventions did not disclose any answer for these. It took time and effort to notify everybody thoroughly about cuts or omits some portion in opera or ballet performance. With this invention, conductor or soloist need just one time dialogue to specify these jumps as preparation, and system provides no break display all through the music score. Even there is no prior specification, this system can recognize and memorize performer's repeat choice. And this information are automatically provide to all display terminals. Thus these issues are all resolved with this invention first time ever.

As third merit, music score display in this system is controlled by unified scheme for all variety of music score forms such as one stem, two stems for piano, several stems for chamber music, full page for orchestra or opera. This system is responsible not only to performance but also to practice, in which interrupt, back up, or restart happen. This system is applicable to human live performance or automatic play with variable tempo. That is to say the system is used for wide variety of music field and in many situations.

As forth point, automatic follow up of playing music has been a bottleneck to practice of conventional automatic turning page. This invention shows concrete and practical solution, and also provides complementary means. So, it provides clear solution to practice.

As fifth merit, renewal of various timing for many display terminals of orchestra is automatically executed with delivering music time information. Minimal compensating operation a few times by just one is enough. This may be conducted by one of player with foot switches. Other members including conductor can enjoy being freed from turning page.

As sixth merit, with this invention, when play first time some operation input are necessary for correcting automatic follow up of playing point. But, in second or later time, operation necessity becomes far less the previous time, because of customized or learning capability. In other word it gets up close automatic. The customized data is valuable for self use as well as for others and general public.

As seventh merit with this invention, current playing point is displayed with cursor. This eliminates displacement or drop off in ensemble. This is immense merit for amateur beginner. Even when play lonely and almost by memory without looking music score, if instantly want to see music score, cursor tells position. Player is free from menial mental work of counting rest and can concentrate into musical expression, because remaining rest is displayed on the screen.

In orchestra rehearse with this invention, direct pointing at full score by conductor transformed in to position in display of each player terminal. So, direct immediate communication is possible, this time saving feature raises efficiency of rehearsals a lot. Then it gives more complete performance or shortens rehearsal time.

As summary, this invention realizes many merits and gives reliable means when compared with paper printed music score as well as related inventions.

DETAILED DESCRIPTION OF THE INVENTION

It is convenient and reliable to use a personal computer mounted software based on this invention for personal use. Of cause, personal computer can be used for other purpose, when compared with the other option of using a specially designed hardware. Not only CRT, but also LCD (liquid crystal display) is available through the same connector on personal computer. LCD is suitable to set on a piano or put on high place. Foot switch as well as mouse can be connected through connector for mouse or USB connector. Audio input and output are common now. Sensor of baton movement is special. It can be made up as electronic equipment box connected to personal computer through USB. When utilizing by video signal analysis, video capture board is available. Detection of conductor's takt is option in the system.

Tablet PC is fit to use at orchestra or ensemble. Two tablet PCs in portrait posture are used for the conductor. One for each player or one for two string players are prepared. Music stand may be smaller than conventional one and no necessary for lamp. All PC are connected with LAN. Wireless LAN is enough capacity and is convenient. Tablet PC has input of pointing, and this is very effectively used for communication between conductor and players with this invention. For group playing on the same music score may have one tablet PC and only displays for others to reduce the cost. Image is supplied from the tablet PC through a distributor. It is good to have a server PC, which has bulk data read/write device such as CD or DVD. This PC delivers music score information, and executes following up playing position, and broadcasts internal music time and clocks to all other terminals. The PC also records and reads/writes of customized data to disk and media. Video analysis requires big computation power, and so it is better to prepare one dedicated computer for this purpose.

Figure 1:
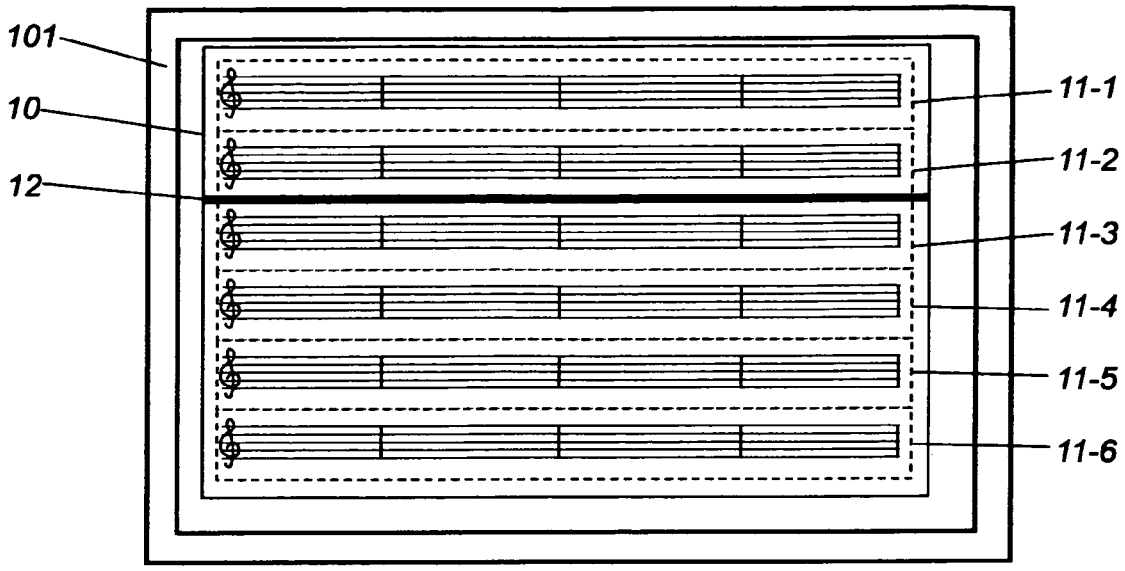
FIG. 1 shows an example of general music score display and its division with this invention.
Figure 2:
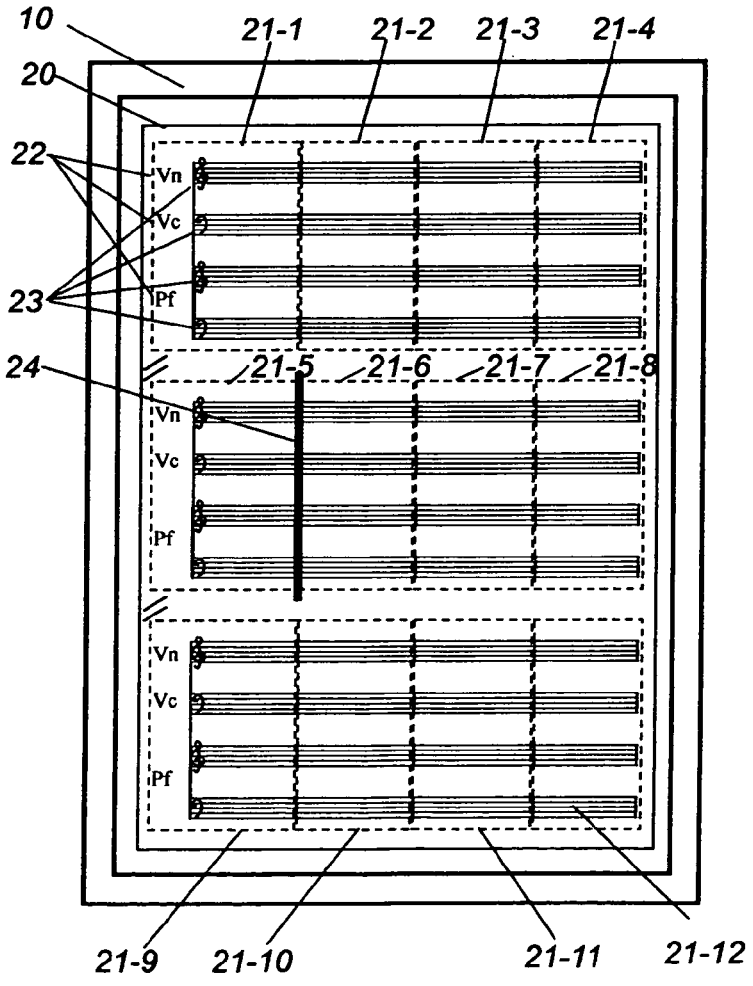
FIG. 2 shows an example of ensemble score display and its division with this invention.
Figure 3:
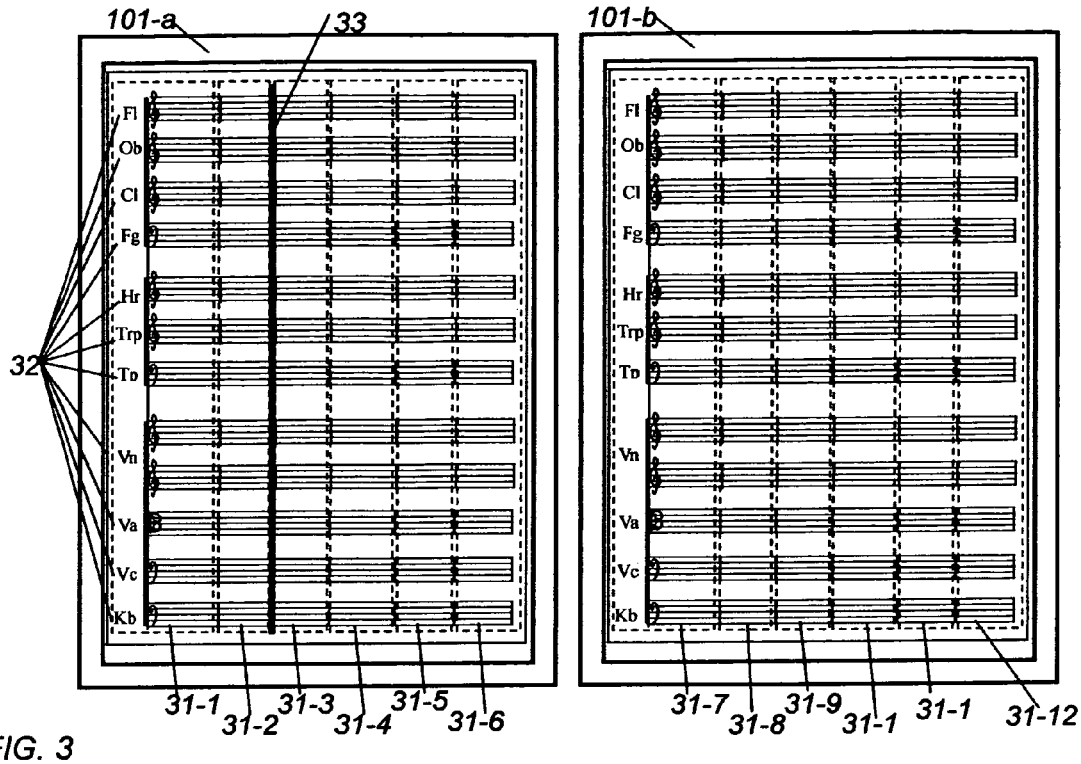
FIG. 3 shows an example of orchestra score display and its division with this invention.
Figure 4:
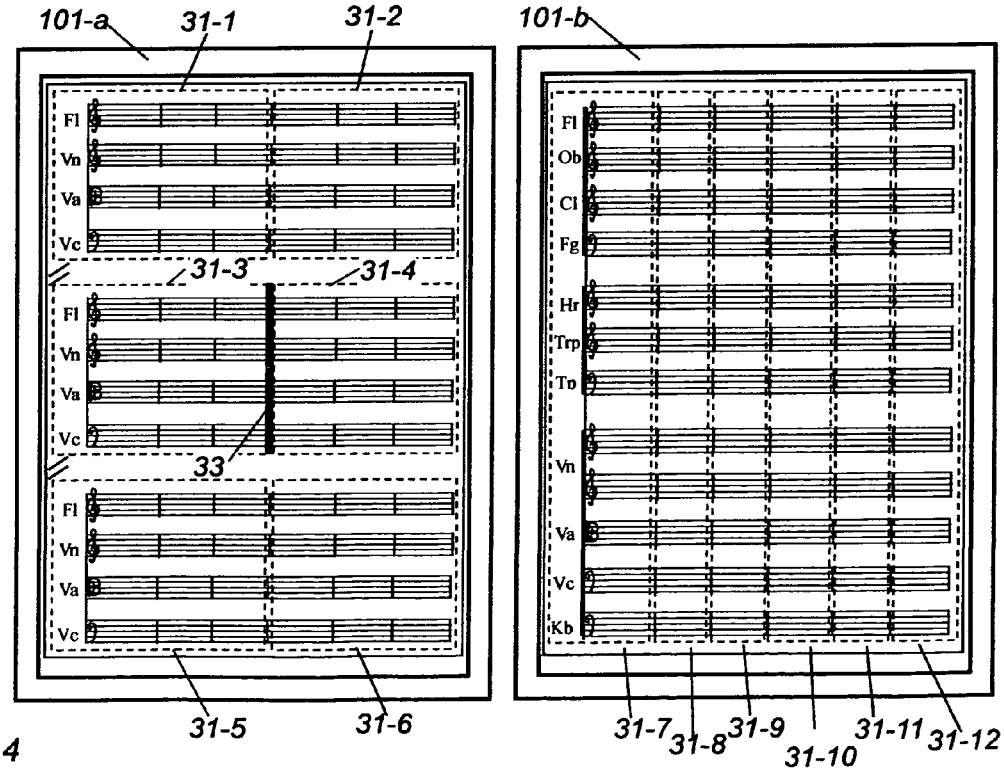
FIG. 4 shows an example of variation from FIG. 3.
Figure 5:
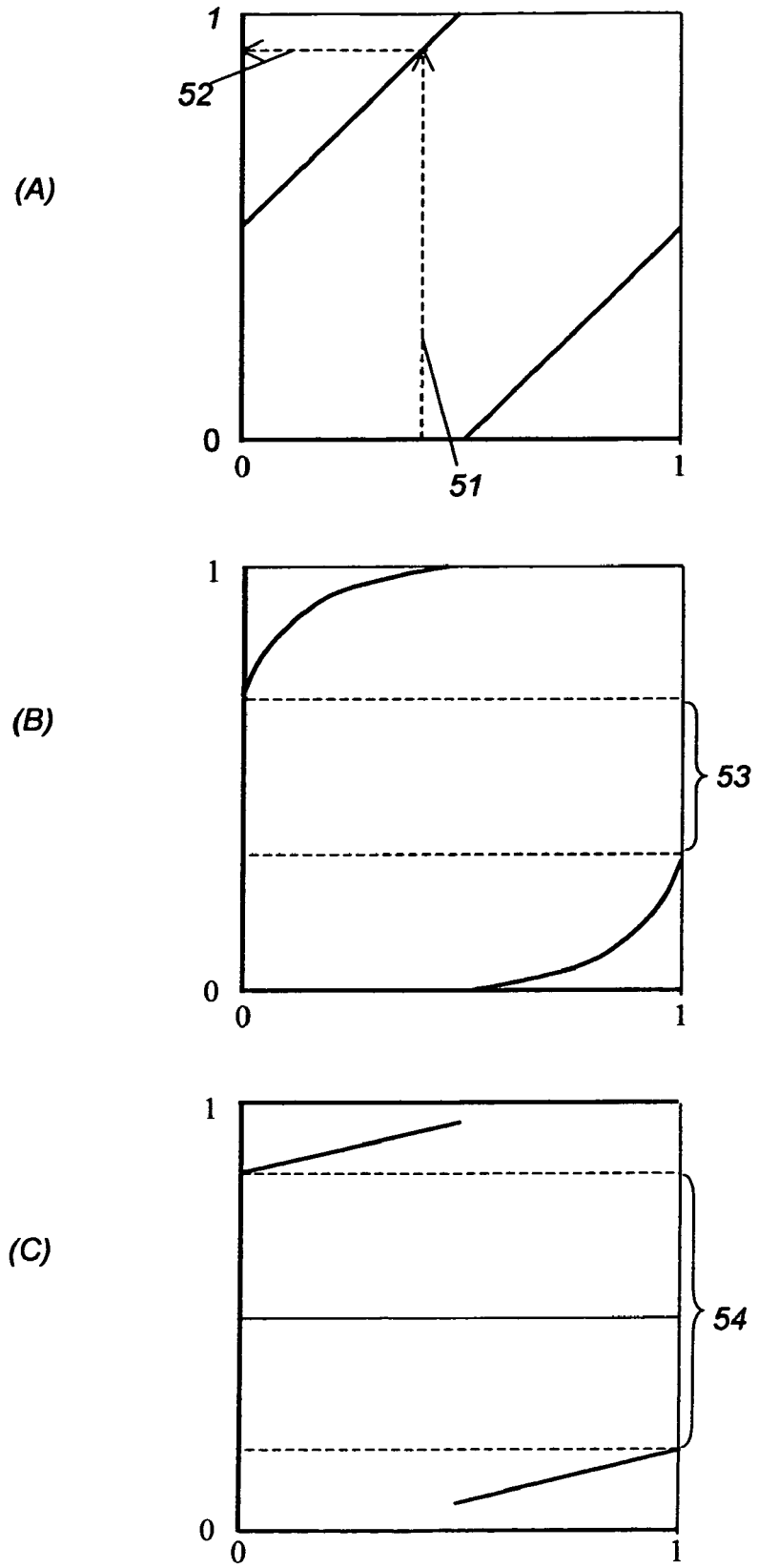
FIG. 5 is three example graphs of mapping function.
Figure 6:
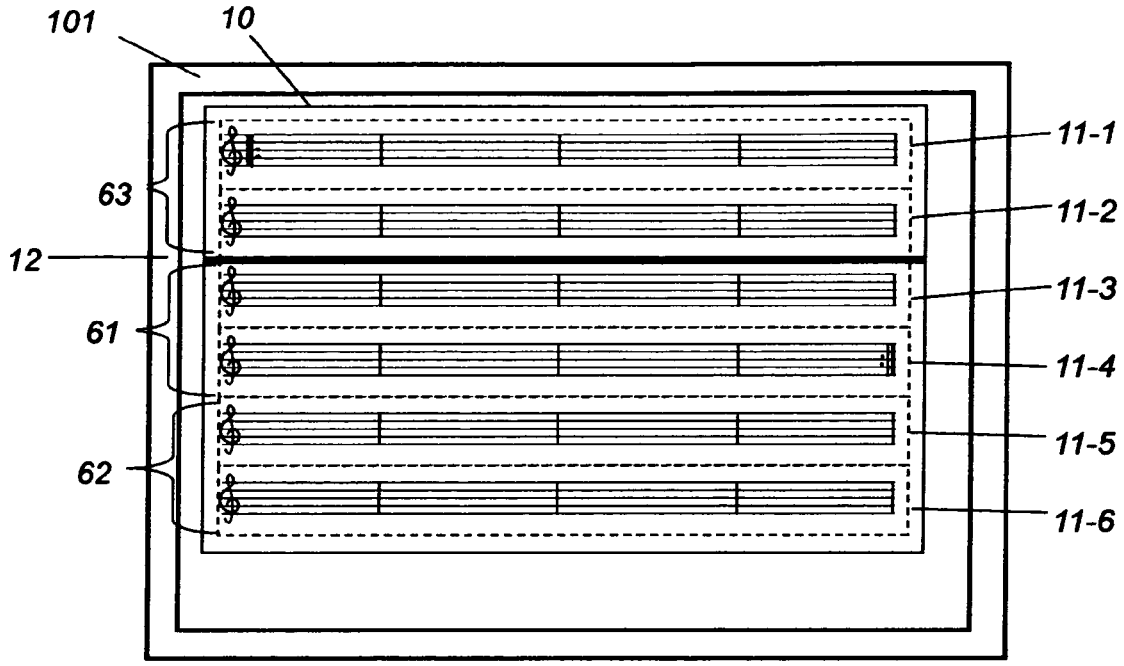
FIG. 6 is an example of music score display at the end of repeat with this invention.
Figure 7:
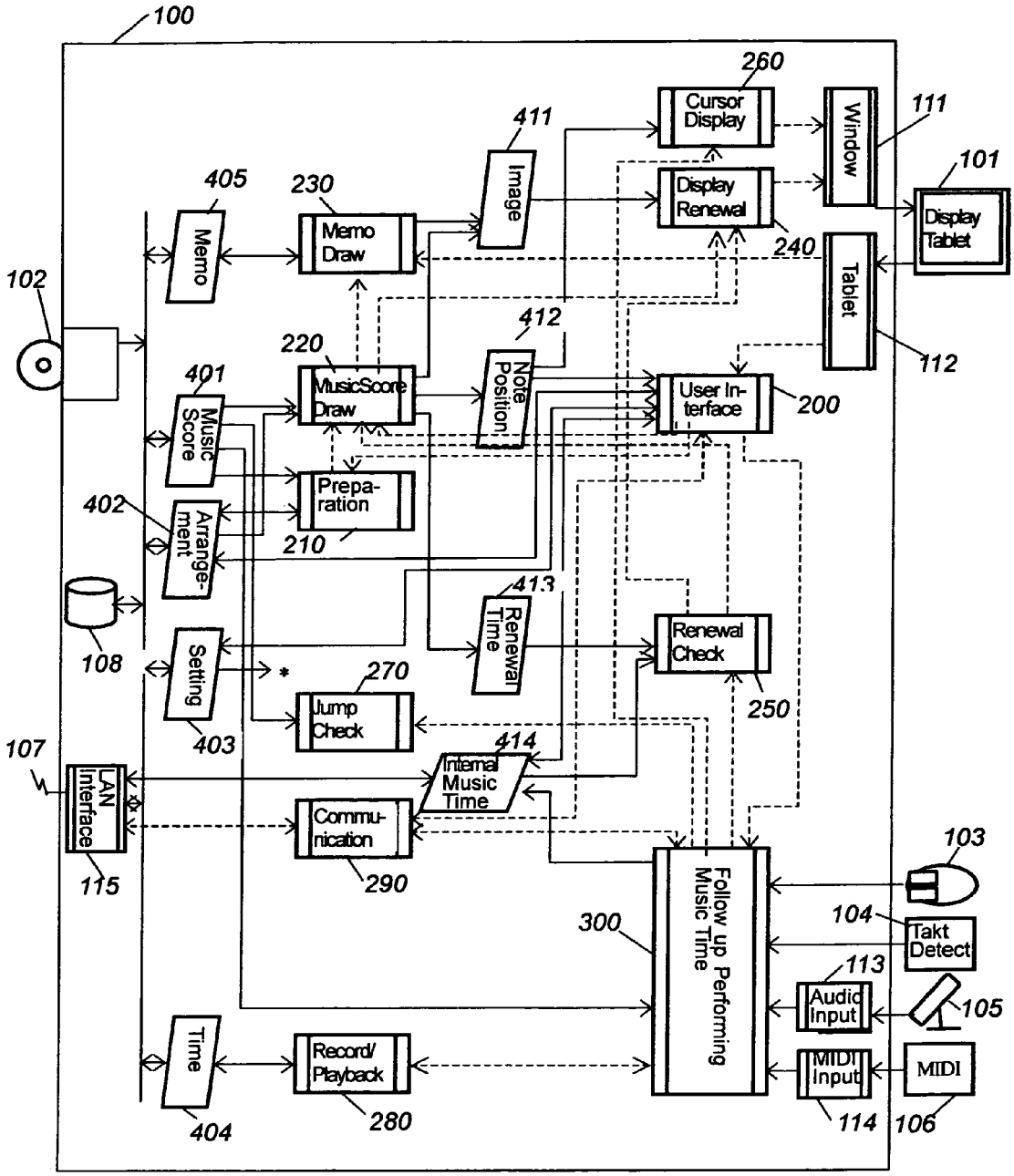
FIG. 7 is schematic diagram of software in a practical example of this invention.

FIG. 7 shows schematic diagram of programs and data, which constitute an embodiment of this invention. Peripheral devices outside of main machine 100 are as follows. Combined display and tablet 101 is a flat panel display covered by a transparent tablet. With tablet PC, device 101 is built in main body. Removable memory media 102 and device to read or write on it are standard one such as flexible disk, CD DVD and memory stick. Mouse 103 may be replaced by two foot switches operated by both feet. Takt detector 104 is built with techniques shown in such as reference 4. Different sensors are used by techniques. All these are interfaced with such as USB, and input signals are analyzed by detection program. In case using video analysis, detection is executed in another computer and takt information is take in through LAN. Here these details are omitted. Standard built in audio input circuit takes in signal of microphone 105, and also, programs for sampling and digitizing 113 are generally provided. MIDI signal source 116 is such as rhythm machine or music sequencer which generates timing signals, or electronic keyboard. Interface circuit and program for MIDI input 114 can be installed easily as standard option. Plural display terminal can be connected through LAN interface 107. Typical LAN is high speed wireless LAN defined by IEEE 802.11.

In FIG. 7, program units are shown by rectangle with double bars in right and left sides, and data units are shown by lozenge, data references are shown by arrow solid line, and queues of program are shown by dotted arrow line. In the figure, data units 401 to 405 at left side are stored or transferred as file between internal disk, removable memory media or other computer through LAN. Data units 411 to 414 in the middle are temporary. Display is based on window and drawn through window managing program 111. Tablet input are given by tablet managing program 112 in form of position in the window. Characters printed on tablet are also recognized here. Communication through LAN is serviced at LAN service program 115. These programs 111 to 115 are provided with general operating system and not described here.

Programming style is like on-line real time control program. Each program unit called task is queued by some event or queued from other task and generally stops after complete programmed procedure and then wait next queue. So, there is no total flowchart and each program unit is not part of it. As queuing event, there are input from external device, input from tablet, queue from LAN, and interrupt from internal timer. Pseudo buttons placed in display as well as touch on music score display cause queue.

Dialog task 200 is actually a group of element tasks. At the beginning, when there is starting queue to this music score display application, initialization task starts and uploads necessary tasks, and generates initial set dialogue, and waits for user input. If user requests general setting, corresponding task starts and enables setting about choice of portrait or landscape setting, choice of one display or two, choice of stand alone or group use, and in group use assign of this machine as master or slave. Master machine generates internal music time and delivers it to slave machines. If there is no request, previous setting is adopted. Now music piece selection task starts and lets user select music piece title. For selected music piece, music score information data 401 and its customized information data 402 to 405 are uploaded. If setting on the music piece dialogue is requested, its task starts and setting on repeats, cut positions if any, and number of takt per measure and its changing point are conducted. Result of these setting is memorized in setting data 403.

After music piece setting dialogue closes in master machine, communication task 290 starts and broadcasts music piece selection and setting data 403, if any change is. At each terminal music score drawing preparation task 210 starts. This task delimits whole music score into staffs according to music score information 401, also selection of parts in each system and systems in page in conductor's display. This procedure may involve trial and error. Result of this music score drawing preparation task 210 is stored in allocation data 402. With this data, transform from music time to page is easy, and drawing is processed without trial and error. Allocation data includes corresponding table of rehearsal number and music time, so that quick response to conductor's pointing of rehearsing portion in the music score.

Music score drawing preparation task 210 queues music score drawing task 220 at its end. Music score drawing task 220 draws music score for each division of this invention from music score data 401 and stored in divided image data 411. At the same time, pair data of note position and music time are stored in note position data 412. And timing to renew that division is calculated and stored in renewal time data 413. Also, at each division queues display renewal task 240. This is continued until fill all the first page. Music score drawing task 220 further runs until drawing of the second page finished. After this, each time renewal takes place, task 220 draws image of next division. Task 220 queues memo drawing task 230 each time it draws for a division. Task 230 draws corresponding portion of memo stored in memo data 405 over image of the division.

When user touches forward page turn button, one of dialog task 200 refers allocation data 402 and queues display renewal task 240 to renew display to the end of page, also queues music score drawing task 220 to draws music score in the next page. In case it is backward page turn button, task 240 write back to top of page and task 220 draws music score in the previous page. Request in form of movement or rehearsal number is processed as follows. One of dialog task 200 get page number by refering allocation data 402, and queues music score drawing task 220 to draw from the top measure of the page to the end of next page, and queues display renewal task 240 to renew one full page.

When user scribes memo on the tablet in memo mode, memo drawing task 230 starts and draw as script, and stores it in memo data 405. If it is not in memo mode, dialog task understands it as restart position, moves cursor to the point, find nearest note from note position data 412, set internal music time to the music time of the note, then broadcasts the music time to other terminals through communication task 290. If playing stops, this point can be restart point, or make comment on the point. Now in the figure, internal music time is written as CMT.

When pseudo start button is touched, it is understood that performing starts from cursor position, that is equal to internal music time data in 414, performing music time follow up task 300 is queued. Also, through communication task 290 set all other terminals in status of starting from the music time. Then, performing music time follow up task 300 follows up the performance and queues cursor display task 260 to move cursor forward. At next takt time, task 300 queues renewal decision task 250 to check if internal music time reaches to timing stored in renewal time data. When it comes to the timing, task 250 queues display renewal task 240 to renew one division of music score display. And task 250 also queues music score draw task 220 to draw music score in the precedent division of next page. Thus cursor display and renewal of music score display proceeds appropriately.

Figure 8:
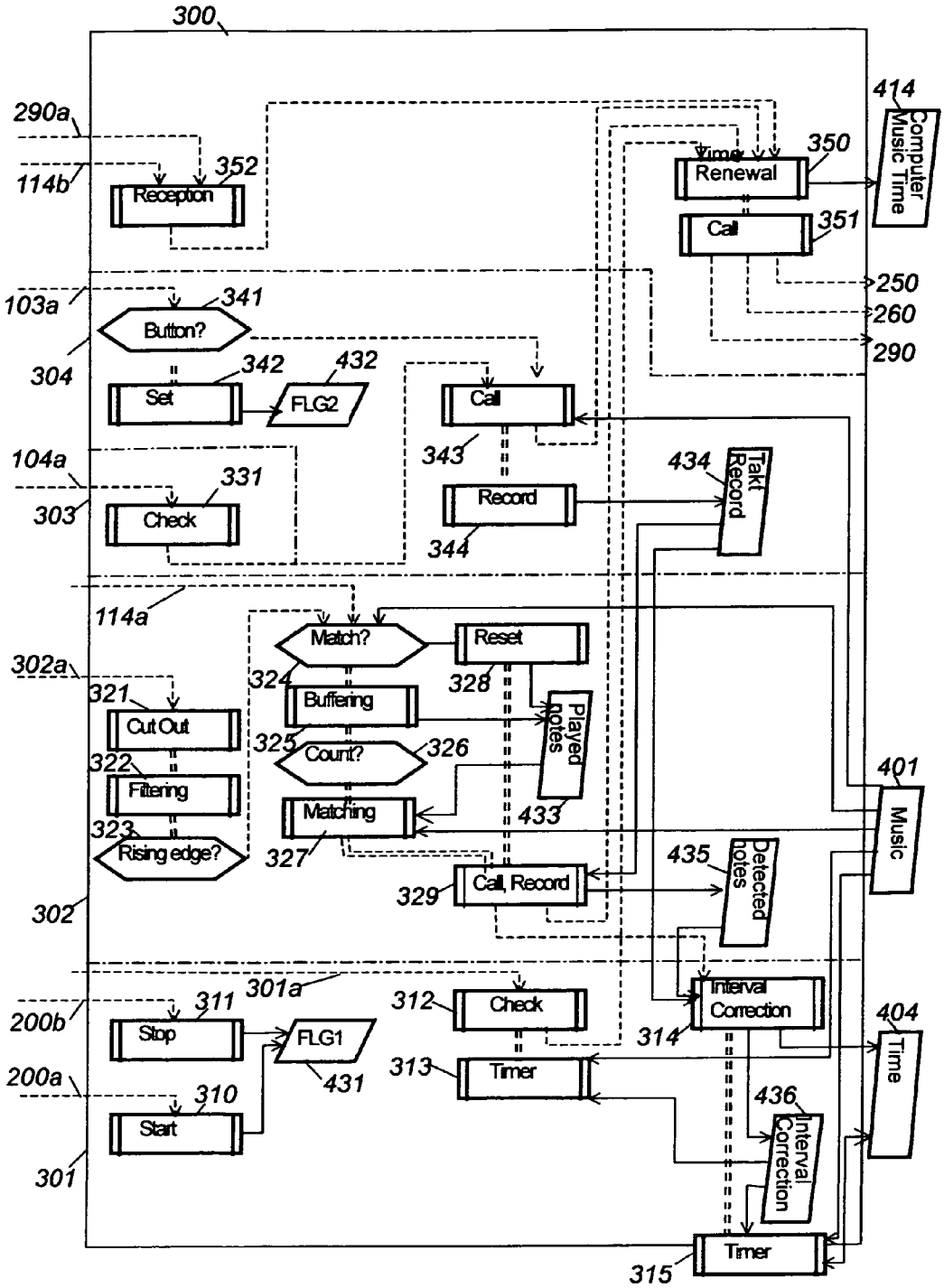
FIG. 8 is schematic diagram of subsystem for playing point follow up in a practical example of this invention.

When pseudo stop button is touched during playing, dialog task 200 stops performance music time follow up task 300, also, queues communication task 290 to inform stoppage to all other terminals FIG. 8 shows detail of an example of embodiment of performing music time follow up task 300. program units are shown by rectangles with double bar in left and right side, or shown by hexagons if it has branch by decision, and data units are shown by lozenges. Referencing of data are shown by solid arrow lines, and queuing between programs are shown by dotted arrow lines. Only key words are written in boxes in the figure, and these contents are written hereafter. Outer frame 300 is divided by dashed line into four areas 301 to 304, which are corresponding programs of four levels timing input.

Area 301 related to first level timing input, that is clock input actually using computer internal timer. Task 310 starts by queue from dialog task 200, which means start command 200*a*. If the program runs in the master computer, task 310 set start flag 431 as ON, and enable all tasks in box 300. Also it sets timer with long time such as 5 seconds. Additionally task-310 sets internal periodical timer to periodically detect performance sound. Task 311 starts by queue from dialog task 200, which means stop command 200*b*. Task 311 sets start flag data 431 as OFF, disables all task in the box 300. Also, task 311 resets the timer not to cause interruption.

Task 312 and 313 are queued by timer interruption 301*a* These two units are consecutively processed, so it is one task. Double dotted line shows this as well as in other places. The task checks both flag 431 and 432 being ON, and queues time renewal task 350. And task 313 is for timer setting. If flag 431 is ON, gets time duration to next clock and set the value to timer. The time duration is read out from time information data 404 corresponding to internal music time 414, if it is in play back mode. If it is not in play back mode, clock duration is calculated from tempo stored in music score data 401. If it is not play back mode but there are corrected duration data 436 and tempo is not changing according to music score data 401, then it takes that corrected duration for timer setting. If it is in recording mode, duration data set to timer is also recorded into time information data 404 at the position of internal music time 414. Now, play back mode and recording mode are independent.

Duration correction task 314 is queued when there is higher than level 2 timing input. Task 314 at first chooses the latest detection from detected takts data 434 and detected sound data 435. If data from 434 and 435 are close each other, it takes higher level data 434. It calculate duration per clock from the ratio of real time interval of chosen detection data and previous detected data and interval of two corresponding music time. It stores this data in corrected duration data 436. If it is in recording mode, stores it in time information data 404. Writing position of this operation are all of clock position between time of latest detection data and time of previous data. Value is the acquired data. In timer set program 315, in play back mode, data comes from time information data 404 at the point of music time 414. If it is not in play back mode, corrected duration data 436 is used as clock duration until next clock. If it is not in play back mode but music score information 401 indicate change of tempo, clock duration is calculated from music score information. In both case, set the timer with acquired duration. By this operation, old setting of timer is canceled by itself, and time is measured by new setting.

Area 302 in FIG. 8 is related to timing input by detection of performing sound. Task 321 to 323 is queued by interruption 302*a* from said periodic timer. Program 321 cuts out predetermined number of audio sampling data, which audio input program 113 has buffered. It memorizes input time of center data as acquisition time. Filtering program 322 collects level data for each filter installed for each music tone. Program 323 detects rising up of each music tone, by catch up change more than threshold between current level and previous level. Detected rising up, its tone and acquisition time, are sent to next queued task 324.

Task including programs 324 to 329 is queued by task 323 or interruption by MIDI key input 114*a*. *Program* 324 detects coincident between current detected tone and expected tones from music score information data 401 within some allowance range around the timing of internal music time. if no coincident found, buffering program 325 stores pair of detected tone and its acquisition time in played sound buffer 433. Decision program 326 decide if the number of detected tones in the buffer 433 reaches the predetermined number, and if it reaches, go to matching program 327, and if not, stop the own task. If program 324 decides as coincident, program 328 resets number of buffered tones to 0, and go to program 329. program 329 checks that flag 432 is ON and music time of detected tone is not near to any of detected takts data 434, and if it fits, queues music time renewal task 350 and duration correction task 314. Then stores internal music time and its acquisition time as recent detection up to predetermined number.

Program 327 does matching between data in the buffer 433 and music score information 401. It sets tone, its sequence, and each interval as retrieving pattern. Also, it picks up same number of adjacent tones from music score data 401 around the music time in data 414 as matching pattern. If retrieving pattern and matching pattern matches within allowance range of error in time intervals, it is successful and go to program 329 with data of music time of the last tone in the matching pattern and acquisition time of corresponding detected tone. If it does not match, move pick up position back and forth and try again. Continue trial until move width reach certain amount and if not successful, stop the own task.

Area 303 is relating to timing input from detection of conductor's takt. Takt detection device 104 sends timing signal 104*a*, and this interrupt signal queues check task 331. Task 331 checks that FLG2 432 is ON, and there is no near direct input referring detected takts data 434, and if they are, queues task 343.

Area 304 is relating to timing input from level 4 direct input. Event signal 103*a* of ON or OFF from input device, which has two buttons such as mouse or foot pedals, queues task 341 to 342. If it is right button, program 341 send it to program 342. Program 342 sets FLG2 in reverse to input signal. During right button is pushed down, FLG2 is OFF, and renewal of clock duration is halted. This is because play position is at portion with unusual tempo, or user is adjusting internal music time. If input signal is ON change of left button, it is taken as direct input of takt. For OFF change of left button, there is no action.

Task 343 to 344 find out music time corresponding to the takt input. If FLG2 432 is ON, music time of an eligible takt nearest to internal music time 414 is chosen. If FLG2 is OFF, music time of an eligible takt next nearest from internal music time 414 referring to music score information 401 id chosen. Internal music time 414 is music time that the system is holding inside, and may jolt out of alignment with sounding performing music time. In case misalignment grow to a few takt, user can let system catch up by holding right button and making extra click on left button, or wait performing comes to internal music time by just holding right button. Program 343 queues renewal time task 350 with acquired music time and real time input happened. Next program 344 memorizes music time and real time of takt input into detected takts data 434. Only fixed number of data are kept in this data 434 and older data are overwritten.

Task 350 to 351 consolidates timing inputs from four levels and from external. Task 352 receives timing signal from external timing master. If setting for this computer is slave mode, this receives time renewal signal 290*a* from communication task 290. Or in other case that master is sequencer, MIDI instruments, or rhythm machine, task 352 accepts timing signal 114*b* from MIDI interface 114. In this latter case, music time does not come, and this task holds current music time renews it when it receives clock signal referring to music score information 401. SO, in both case, task 352 queued task 350 with music time and its real time.

Program 350 renews internal music time 414 to music time brought in. Data is memorized with its real time. Then program 351 queues renewal decision task 250 and cursor display task 260. If the computer is the timing master, program 351 delivers music time and its real time to other computers through communication task 290.

An embodiment of performing music time follow up function in this invention is described above. It can utilize four level timing input according to their priority. Current music time is kept, is referred from other program and is delivered to other computers.

Above described embodiment is available for both playing alone or playing with group. Hereinafter composition and function in use for orchestra is described in more detail. One computer is used as a data server, and executes read write of removable media or mass library storage, and deliver data to other computers. Also, the computer is assigned as a timing master, which executes performing music time follow up function 300. Exclusive operator, if there is, makes necessary correction of music time by direct input to this computer. So, the operator should keep visual and audio communication with the conductor, catch even soft voice, but may be at place not visible from audience. Other computers are set as timing slave, and receive music time delivery and execute display renewal by it.

Computer for the conductor is set as operation master. Conductor can specify restart position by touch on the point in displayed music score during stop status. During start status, music time of touched position and part are memorized for later review, so system helps to go back to the point to be reviewed. Touch during public performance can be used adjust timing on the fly, when misalignment happens between orchestra and soloist, this touch position translate into music time and delivered to all other computer and displayed with special mark. Display at conductor's terminal is so frequent and needs processing power that it may be different machine with the data server. Operation of start or stop may be done by conductor, but if there is a dedicated operator, the operator should do this. Operator also directly input the first down beat. Because time from pushing start button to the first takt is once set as 5 seconds, but actually it vary time by time. If automatic performing sound detection or takt detection works well, it is not necessary for operator to input this.

The timing master plays back time information 404, or records time information, and manage its file. So for example, it is possible to respond to the request to play back with timing data of certain day's rehearsal. Computers at players make allocation data 402 according to music score information of the part and prepares for display. Memo writing on music score is supported. In case there is no exclusive operator, assigned player make adjustment using foot pedal as direct input, this input forwarded to timing master computer.

Now, hereinafter described is another embodiment, which is expansion of direct input in the performing music time follows up function 300. One of the points of expansion is use of touch panel on the display. Touching on note, rest, or bar specify music time of touched note or object is performing music time of the moment of touch. This operation can specify music time more directly and without ambiguity than mouse or foot pedal. Preliminary set is necessary, that touching in start status is taken as input of timing and music time. For this operation, operator whose hand is free is necessary. So, assistant not playing or player who is not playing at the portion of music piece does this.

Second expansion is that mouse or foot input has multiple meanings to be chosen at setting dialogue. In former embodiment, direct input is taken as same frequency with takt, so, input takt is connected to the takt nearest from internal music time. But, one click is not enough to adjust more than two takt misalignments between performance music time and internal music time. To do it with foot pedal during play is a little hard thing. Then, If change of interpret of input timing to not takt but head of measure or more bigger head of staff, one click can adjust big misalignment. Program may find nearest bar or head-of staff from the current internal music time, and replace current time to found time at the input timing. User can set by setting dialog which of takt, bar or staff does adjusting timing input means.

Further more, adjusting points may be displayed in music score with special mark like pedal mark for piano music score. Places of the mark are selected in consideration on easiness of foot operation such as in the rest and provided with music score information. User input only when there is misalignment between internal music time and performing music time at the point of these special marks, which is different with conventional pedal mark for piano. Use of direct input for these special mark is set preliminary.

This invention provides music score display of all music scenes, such as solo, ensemble, orchestra, band, opera, or musical. Also, it is applicable to any ethnic music with different notation with western music. This system is effective to both beginner and professional users. Time efficiency is improved much for orchestra rehearsals. Soloists will be free from pressure of play from memory. It can be used at concert as well as in training room, or at individual home. This invention can be provided as application program for personal computer, computer system preinstalled program of this invention, or system of networked computers.

What is claimed is:

1. A computer-readable storing device storing a computer program for showing music score, said program using:

first data memory area, which holds base data to be transformed into images of music score of a music piece, and second data memory area, which holds consecutive duration time of every beats along said music piece, and said program including:

first instruction group for advancing internal music time, which expresses position in the music piece and is indicated by pair of measure number and beat number or its modified form, by reading out said consecutive duration time from the second data memory area and measuring the duration time one by one, second instruction group for setting up partition of display space and generating image segment for each partition of each page using data in the first data memory area, third instruction group for replacing displaying image segment at individual partition with new image segment assigned to the same partition in the following page, when said internal music time reaches individual music time value assigned for the new image segment, and fourth instruction group for correcting difference between internal music time and actual performing music time by using timing input derived from performance.

2. The computer-readable storing device storing a computer program for showing music score claimed in claim 1, wherein the second instruction group including instructions for:

deciding said music time value for a new image segment, so that the partition assigned to the image segment, which includes note or rest corresponding to said music time, is at least one partition away in both directions from the partition assigned to the new image segment.

3. The computer-readable storing device storing a computer program for showing music score claimed in claim 2, wherein the second instruction group further including instructions for:

deciding said music time value for a new image segment, so that the partition assigned to the image segment, which includes note or rest corresponding to said music time, is located outside of the center portion of display, then no replacement occurs all over the page while performing point is in this center portion.

4. The computer-readable storing device storing a computer program for showing music score claimed in claim 1, wherein the fourth instruction group further including instructions for:

accepting multi level timing input, and correction lower reliability level input by higher reliability level input.

5. The computer-readable storing device storing a computer program for showing music score claimed in claim 1, said program further including:

fifth instruction group for calculating ratio of physical time period from previous correction to current correction against physical time period from previous correction to physical time of internal music time of corrected point, and then modifying duration times thereafter in the second data memory by multiplied by the ratio, when correction happened.

6. The computer-readable storing device storing a computer program for showing music score claimed in claim 1, said program further including:

sixth instruction group for recording and storing modified duration times, which reflect the correction by the fourth instruction group, so that the program can use said recorded and stored data as data of the second data memory area at next playing time.

7. The computer-readable storing device storing a computer program for showing music score claimed in claim 6, wherein the sixth instruction group including instructions for:

allowing user to select options of (A) recording by overwrite in the second data memory area, (B)recording to other memory area, and (C)non-recording.

8. The computer-readable storing device storing a computer program for showing music score claimed in claim 1, which is used at master apparatus and said program further including:

seventh instruction group for delivering said internal music time to slave apparatuses.

9. The computer-readable storing device storing a computer program for showing music score claimed in claim 1, said program further including:

eighth instruction group for transforming in both directions between music time and page and position in display, ninth instruction group for getting music time from the position by instructions of eighth group, when a user points on said position in displayed music score, and transmitting the music time to other apparatuses, and tenth instruction group for obtaining page and position in display from the music time by instructions of eighth group, when receiving music time sent from the apparatus user pointed, and displaying the music score at obtained page and displaying a pointer at the obtained position in displayed music score.

10. The computer-readable storing device storing a computer program for showing music score claimed in claim 1, wherein base data held in the first data memory area includes adjusting positions data, at which position special mark are displayed along the staff, said data is expressed by music time or able to be transformed to music time, also, the fourth instruction group including instructions for:

detecting signal from human operating timing input device telling the playing position comes to the adjusting position, and on detection, finding one adjusting position nearest and within allowance range from the current internal music time out of the first data memory area, and correct internal music time to music time associated to the adjusting position found.

11. The computer-readable storing device storing a computer program for showing music score claimed in claim 1, said program further including:

eleventh instruction group for displaying and updating remaining number of measure until end of consecutive rest measure while internal music time is in said consecutive rest measures.

12. The computer-readable storing device storing a computer program for showing music score at a slave apparatus, said program using:

score data memory area, which holds base data to be transformed into images of music score of a music piece, and said program including instructions of:

first group for receiving real time internal music time from a master apparatus, said music time expresses position in the music piece, and is indicated by pair of measure number and beat number or equivalent to the pair, second group for setting up partition of display space and generating image segment for each partition of each page using data in the score data memory area, third group for replacing displaying image segment at individual partition with new image segment assigned to the same partition in the following page, when said internal music time reaches individual music time value preset for the new image segment.

13. An apparatus for showing music score comprising of:

first data memory for holding base data to be transformed into images of music score of a music piece, second data memory for holding consecutive duration time of every beats along said music piece, an advancing means for advancing internal music time, which expresses position in the music piece and is indicated by pair of measure number and beat number or its modified form, by reading out said consecutive duration time from the second data memory area and measuring the duration time one by one, a display setting means for setting up partition of display space and generating image segment for each partition of each page using data in the first data memory area, an image replacing means for replacing displaying image segment at individual partition with new image segment assigned to the same partition in the following page, when said internal music time reaches individual music time value preset for the new image segment, and a time correcting means for correcting difference between internal music time and actual performing music time by using timing input derived from performance.

14. Computer readable media including duration time data in the second data memory area corresponding to a music piece, said duration time data is made by or made and duplicated later by the computer program claimed in claim 6.

15. Method for music display and computer readable media for the method,

Contents of said media being prepared for a music work or a music composition, comprising music notation data, data of tempo or duration time of beats along whole said music work, and data of timing adjusting points expressed with music time comprising bar number, beat number and sub-beat timing number, Said method being executed co-operatively by a music display system with timing input device and a musician, and the method comprising following steps:

Step 1: The media is set to the music display system, and the music display system loads the data on the media, Step 2: The music display system display a part of said music notation and one or plural special marks at said timing adjusting points, that is, horizontally relative position to notes corresponding to music time of each adjusting point and vertically up or down side of staff, Step 3: The musician performs along displayed music notes, and the music display system starts or continues to keep updating an internal music time for following up a performing music time of the musician, using said tempo data or said duration time of beats, Step 4: The Musician recognizes each of said special marks, and inputs timing from said timing input device at exact timing of music time the mark placed at, Step 5: The music display system adjusts the internal music time by replacing it by music time of the special mark, that is, the adjusting point, and optionally adjusts said tempo or said duration time of beats, Step 6: The music display system update the display contents when the internal music time reaches predetermined point in one of ways: turning page; scrolling up; or part-by-part rolling down, new page or portion may include special mark as described in Step 2.

* * * * *